US011312604B2

(12) United States Patent
Mehta et al.

(10) Patent No.: US 11,312,604 B2
(45) Date of Patent: Apr. 26, 2022

(54) FLEXIBLE HIGH SPEED FILLING LINE FOR PERSONALIZED BEVERAGE PACKAGE MIXES

(71) Applicant: The Coca-Cola Company, Atlanta, GA (US)

(72) Inventors: Anish Mehta, Alpharetta, GA (US); Gregg Carpenter, Marietta, GA (US); Eric L. Spann, Kennesaw, GA (US); Mamunur Rahman, Smyrna, GA (US); Hitesh Patel, Marietta, GA (US); Dinesh C. Patel, Cumming, GA (US); Manuel I. Garcia, Marrietta, GA (US); Sergey Grey Ivanov, Austell, GA (US)

(73) Assignee: THE COCA-COLA COMPANY, Atlanta, GA (US)

( * ) Notice: Subject to any disclaimer, the term of this patent is extended or adjusted under 35 U.S.C. 154(b) by 25 days.

(21) Appl. No.: 16/756,277

(22) PCT Filed: Oct. 17, 2018

(86) PCT No.: PCT/US2018/056207
§ 371 (c)(1),
(2) Date: Apr. 15, 2020

(87) PCT Pub. No.: WO2019/079387
PCT Pub. Date: Apr. 25, 2019

(65) Prior Publication Data

US 2020/0331739 A1 Oct. 22, 2020

Related U.S. Application Data

(60) Provisional application No. 62/573,314, filed on Oct. 17, 2017.

(51) Int. Cl.
*B67C 3/02* (2006.01)
*B67C 3/06* (2006.01)
*B67C 3/20* (2006.01)

(52) U.S. Cl.
CPC ..... *B67C 3/023* (2013.01); *B67C 3/06* (2013.01); *B67C 3/208* (2013.01)

(58) Field of Classification Search
CPC ..... B67C 3/06; B67C 3/023; B67C 3/208
(Continued)

(56) References Cited

U.S. PATENT DOCUMENTS 2,676,742 A * 4/1954 Day ..... B67C 3/2628 141/39
2,988,450 A 6/1961 Bulatkin
(Continued)

FOREIGN PATENT DOCUMENTS

WO 2011112315 A1 9/2011
WO 2013094587 A1 6/2013
(Continued)

OTHER PUBLICATIONS

International Search Report and Written Opinion, PCT/US2018/056207, dated Feb. 25, 2019 (14 pp.).
(Continued)

*Primary Examiner* — Timothy L Maust
(74) *Attorney, Agent, or Firm* — Eversheds Sutherland (US) LLP

(57) ABSTRACT

The present application provides a filling line for filling a container with one of a number of different beverages. The filling line may include a water circuit with a counter-pressure nozzle to fill the container with carbonated water and one or more micro-ingredient towers with a number of
(Continued)

micro-ingredients therein positioned downstream of the counter-pressure nozzle to fill the container with the micro-ingredients.

13 Claims, 7 Drawing Sheets

(58) Field of Classification Search
USPC ..... 141/144–148, 263, 279, 284
See application file for complete search history.

(56) References Cited

U.S. PATENT DOCUMENTS 3,093,165 A * 6/1963 Risser ..... B67C 3/04 141/140
4,350,187 A 9/1982 Trusselle et al.
4,582,102 A * 4/1986 Risser ..... B67C 3/202 141/144
4,951,719 A 8/1990 Wiley et al.
5,803,320 A * 9/1998 Cutting ..... B67D 1/0036 222/129.1
6,463,964 B2 * 10/2002 Clusserath ..... B67C 3/065 141/104
6,470,922 B2 * 10/2002 Sindermann ..... B67C 3/10 141/37
7,913,879 B2 * 3/2011 Carpenter ..... B67D 1/0085 222/129.4
8,479,784 B2 * 7/2013 Goldman ..... B67D 1/0041 141/144
8,505,594 B2 * 8/2013 Krulitsch ..... B67C 3/2608 141/104
9,085,449 B2 * 7/2015 Goldman ..... B65B 55/12
9,120,066 B2 * 9/2015 Meinzinger ..... B01F 3/04794
10,562,757 B2 * 2/2020 Biasi ..... B67D 1/0036
2010/0237099 A1 9/2010 Carpenter et al.
2014/0263406 A1 9/2014 Green et al.
2018/0215604 A1 * 8/2018 Rudick ..... B67D 1/0888

FOREIGN PATENT DOCUMENTS

WO 2015004443 A1 1/2015
WO 2017097785 A1 6/2017

OTHER PUBLICATIONS

Extended Search Report, EP 18869170.3, dated Jul. 21, 2021 (10 pp.).

* cited by examiner

FLEXIBLE HIGH SPEED FILLING LINE FOR PERSONALIZED BEVERAGE PACKAGE MIXES

TECHNICAL FIELD

The present application and the resultant patent relate generally to high-speed beverage container filling lines and more particularly relate to filling lines that can fill beverage containers with any number of different beverage brands and flavors in any desired order to create personalized beverage package mixes.

BACKGROUND OF THE INVENTION

Generally described, beverage bottles and cans are filled in a filling line with a beverage via a batch process. The beverage components (usually concentrate, sweetener, and water) are mixed in a blending area and then carbonated if desired. The finished beverage product is then pumped to a filler bowl. The containers are filled with the finished beverage product via a filler valve as the containers advance along the filling line. The containers then may be capped, labeled, packaged, and transported to the consumer.

As the number of different beverage products continues to grow, however, bottlers face increasing amounts of downtime because the filling lines need to be changed over from one product to the next. This changeover may be a time consuming process because the tanks, pipes, and filler bowl must be flushed with water before being refilled with the next product. Bottlers thus may be reluctant to produce a small volume of a given product because of the required downtime between production runs.

Recent improvements in beverage dispensing technology have focused on the use of micro-ingredients. With micro-ingredients, the traditional beverage bases are separated into their constituent parts at much higher dilution or reconstitution ratios. For example, the "COCA-COLA FREESTYLE®" refrigerated beverage dispensing units offered by The Coca-Cola Company of Atlanta, Ga. provide a significant increase in the number and types of beverages that may be offered by a beverage dispenser of a conventional size or footprint. Generally described, the "COCA-COLA FREESTYLE®" refrigerated beverage dispensing units create a beverage by combining a number of highly concentrated micro-ingredients with a macro-ingredient such as a sweetener and a diluent such as still or carbonated water. The micro-ingredients generally are stored in cartridges positioned within or adjacent to the beverage dispenser itself. The number and type of beverages offered by the beverage dispenser thus may be limited only by the number and type of micro-ingredient cartridges positioned therein.

There is thus a desire to apply micro-ingredient technology to high-speed beverage container filling lines. Specifically, an improved high speed beverage container filling line that can quickly adapt to filling different types of beverages as well as products with varying additives and/or flavors. The beverage container filling line preferably can produce these beverages with reduced downtime and/or without costly changeover procedures. The beverage container filling line also should be able to customize products in a high speed and efficient manner. There is also a desire to produce a mix of flavors or beverages simultaneously.

SUMMARY OF THE INVENTION

The present application and the resultant patent provide a filling line for filling a container with one of a number of different beverages. The filling line may include a water circuit with a counter-pressure nozzle to fill the container with carbonated water and one or more micro-ingredient towers with a number of micro-ingredients therein positioned downstream of the counter-pressure nozzle to fill the container with the micro-ingredients.

The present application and the resultant patent further provide a method of filling a container with a beverage along a filling line. The method may include the steps of filling the container with carbonated water from a counter-pressure nozzle, advancing the container to a sweetener nozzle, filling the container with sweetener, advancing the container to a micro-ingredient tower, and filling the container with one or more micro-ingredients via a number of dosing needles.

These and other features and improvements of the present application and the resultant patent will become apparent to one of ordinary skill in the art upon review of the following detailed description when taken in conjunction with the shown drawings and the appended claims.

DETAILED DESCRIPTION

Figure 1:
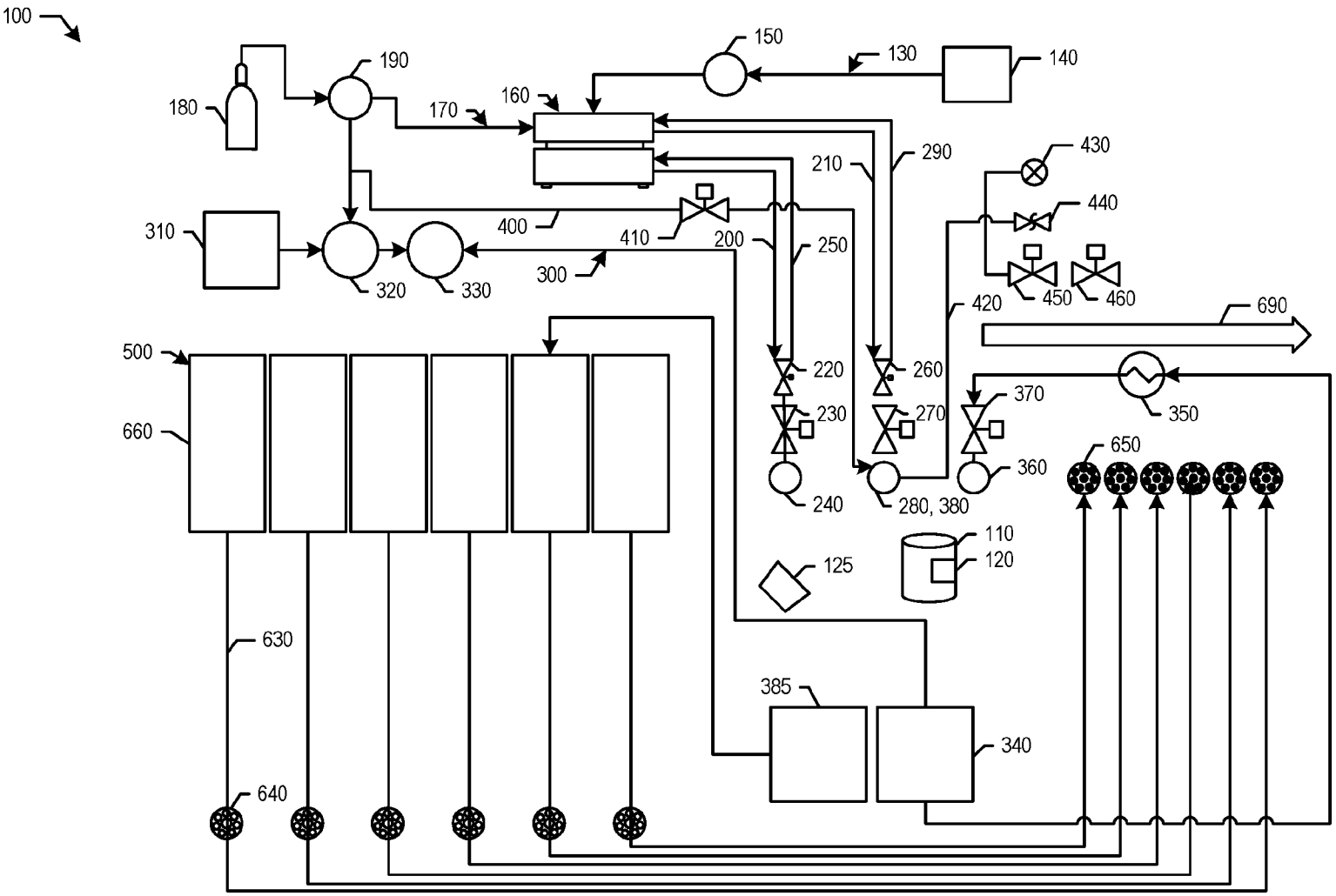
FIG. 1 is a schematic diagram of a high-speed filling line as may be described herein.

Referring now to the drawings, in which like numerals refer to like elements throughout the several views, FIG. 1 show an example of a filling line 100 as may be described herein. The filling line 100 may dispense many different types of beverages or other types of fluids. Specifically, the filling line 100 may be used with diluents, micro-ingredients, macro-ingredients, and other types of fluids. The diluents generally include plain water (still water or non-carbonated water), carbonated water, and other fluids.

Generally described, the macro-ingredients may have reconstitution ratios in the range from full strength (no dilution) to about six (6) to one (1) (but generally less than about ten (10) to one (1)). As used herein, the term "reconstitution ratio" refers to the ratio of diluent (e.g., water or carbonated water) to beverage ingredient. Therefore, a macro-ingredient with a 5:1 reconstitution ratio refers to a macro-ingredient that is to be dispensed and mixed with five parts diluent for every part of the macro-ingredient in the finished beverage. Many macro-ingredients may have reconstitution ratios in the range of about 3:1 to 5.5:1, including 4.5:1, 4.75:1, 5:1, 5.25:1, 5.5:1, and 8:1 reconstitution ratios.

The macro-ingredients may include sweeteners such as sugar syrup, HFCS ("High Fructose Corn Syrup"), FIS ("Fully Inverted Sugar"), MIS ("Medium Inverted Sugar"), mid-calorie sweeteners including nutritive and non-nutritive or high intensity sweetener blends, and other types of nutritive sweeteners and the like. The viscosity of the macro-ingredients may range from about 1 to about 10,000 centipoise and generally over about 100 centipoises or so when chilled. Other types of macro-ingredients may be used herein.

The micro-ingredients may have reconstitution ratios ranging from about ten (10) to one (1) and higher. Specifically, many micro-ingredients may have reconstitution ratios in the range of about 20:1, to 50:1, to 100:1, to 300:1, or higher. The viscosities of the micro-ingredients typically range from about one (1) to about six (6) centipoise or so, but may vary from this range. In some instances, the viscosities of the micro-ingredients may be forty (40) centipoise or less. Examples of micro-ingredients include natural or artificial flavors; flavor additives; natural or artificial colors; artificial sweeteners (high potency, nonnutritive, or otherwise); antifoam agents, nonnutritive ingredients, additives for controlling tartness, e.g., citric acid or potassium citrate; functional additives such as vitamins, minerals, herbal extracts, nutricuticals; and over the counter (or otherwise) medicines such as pseudoephedrine, acetaminophen; and similar types of ingredients. Various acids may be used in micro-ingredients including food acid concentrates such as phosphoric acid, citric acid, malic acid, or any other such common food acids. Various types of alcohols may be used as either macro-ingredients or micro-ingredients. The micro-ingredients may be in liquid, gaseous, or powder form (and/or combinations thereof including soluble and suspended ingredients in a variety of media, including water, organic solvents, and oils). Other types of micro-ingredients may be used herein.

Other typical micro-ingredients for a finished beverage product may include micro-ingredient sweeteners. Micro-ingredient sweeteners may include high intensity sweeteners such as aspartame, Ace-K, steviol glycosides (e.g., Reb A, Reb M), sucralose, saccharin, or combinations thereof. Micro-ingredient sweeteners also may include erythritol when dispensed in combination with one or more other sweetener sources or when using blends of erythritol and one or more high intensity sweeteners as a single sweetener source.

Other typical micro-ingredients for supplementing a finished beverage product may include micro-ingredient flavor additives. Micro-ingredient flavor additives may include additional flavor options that can be added to a base beverage flavor. The micro-ingredient flavor additives may be non-sweetener beverage component concentrates. For example, a base beverage may be a cola flavored beverage, whereas cherry, lime, lemon, orange, and the like may be added to the cola beverage as flavor additives, sometimes referred to as flavor shots. In contrast to recipe-based flavor versions of finished beverages, the amount of micro-ingredient flavor additive added to supplement a finished beverage may be consistent among different finished beverages. For example, the amount of cherry non-sweetener component concentrate included as a flavor additive or flavor shot in a cola finished beverage may be the same as the amount of cherry non-sweetener component concentrate included as a flavor additive or flavor shot in a lemon-lime finished beverage. Additionally, whereas a recipe-based flavor version of a finished beverage is selectable via a single finished beverage selection icon or button (e.g., cherry cola icon/button), a flavor additive or flavor shot may be a supplemental selection in addition to the finished beverage selection icon or button (e.g., cola icon/button selection followed by a cherry icon/button selection).

The filling line 100 and methods described hereinafter are intended to fill a number of containers 110 in a high-speed fashion. The containers 110 are shown in the context of conventional beverage bottles. The containers 110, however, also may be in the form of cans, cartons, pouches, cups, buckets, drums, or any other type of liquid carrying device. The nature of the devices and methods described herein is not limited by the nature of the containers 110. Any size or shape of container 110 may be used herein. Likewise, the containers 110 may be made out of any type of conventional material. The containers 110 may be used with beverages and other types of consumable products as well as any nature of nonconsumable products. Each container 110 may have one or more openings of any desired size and a base.

Each container 110 may have an identifier 120 such as a barcode, a Snowflake code (QR code), color code, RFID tag, or other type of identifying mark positioned thereon. The identifier 120 may be placed on the container 110 before, during, or after filling. If used before filling, the identifier 120 may be used to inform the filling line 100 as to the nature of the ingredients to be filled therein as will be described in more detail below. Any type of identifier or other mark may be used herein. The filling line 100 may have one or more sensors 125 capable of reading the identifier 120. The sensors 125 may be of conventional design and may be in communication with one or more controllers or other type of processors. The controllers may be any type of programmable logic device. The controllers may be local and/or remote.

The filling line 100 may include one or more water circuits 130. The water circuits 130 may extend from a water source 140. The water source 140 may a municipal water source or any type of conventional water supply. The water circuit 130 may have a number of water distribution devices such as a pressure regulator 150 as well as conventional devices such as a booster pump, a backflow preventer valve, a storage tank, and a filtration device. Other types of water distribution devices may be used herein in any order.

The water circuit 130 may include a chiller/carbonator 160. The chiller/carbonator 160 may be of conventional design and may be any type of heat exchange device to chill the flow of water therethrough. One or more chiller/carbonator 160 may be used. The still water may be chilled to about 32 to about 36 degrees Fahrenheit (about 0 to about 2.2 degree Celsius) at about 50 to 60 psi (about 3.4 to about 4.1 bar). The chiller/carbonator 160 may be in communication with a carbon dioxide circuit 170. The carbon dioxide circuit 170 may include a carbon dioxide source 180 such as a conventional carbon dioxide tank and the like. The carbon dioxide source 180 may be in communication with the chiller/carbonator 160 via a pressure regulator 190 and other types of conventional devices such as a pressure relief valve and the like. The pressure regulator 190 and the pressure relief valve may be of conventional design and may deliver a flow of carbon dioxide at about 70 psi (about 4.8 bar). The carbonated water may be at about 32 to about 40 degrees Fahrenheit (about 0 to about 4.4 degrees Celsius) at about 50 to about 100 psi (about 3.4 to about 6.9 bar).

The water circuit 130 may extend from the chiller/carbonator 160 to a still water line 200 for still water and to a carbonated water line 210 for carbonated water. The still water line 200 may include a flow meter 220, a shut off valve 230, and other components. The components of the still water line 200 may be of conventional design. The flow meter 220 may be a conventional needle valve and the like. The shut off valve 230 may be a conventional open or shut solenoid valve and the like. The still water line 200 may extend to a still water dispensing head 240. A still water recirculation line 250 may be used between the chiller/carbonator 160 and the still water dispensing head 240 to keep the still water chilled to an appropriate temperature. Other components and other configurations may be used herein.

The carbonated water line 210 likewise may include a flow meter 260, a shut off valve 270, and other components. The components of the carbonated water line 210 may be of conventional design. The flow meter 260 may be a conventional needle valve and the like. The shut off valve 270 may be a conventional open or shut solenoid valve and the like. The carbonated water line 210 may extend to a carbonated water dispensing head 280. A carbonated water recirculation line 290 may be used between the chiller/carbonator 160 and the carbonated water dispensing head 280 to keep the carbonated water chilled to an appropriate temperature. Other components and other configurations may be used herein.

The filing line 100 also may include a sweetener circuit 300. The sweetener circuit 300 may include a sweetener such as high fructose corn syrup and/or others such as the examples described above. The sweetener circuit 300 may include one or more sweetener sources 310. The sweetener sources 310 may be conventional two and one half to five gallon bag-in-box ("BIB") containers or any other type of container. An alternative sweetener source 385 may be refrigerated and may be used for non-nutritive sweeteners and the like. The flow of sweetener may be pumped by a sweetener pump 320. The sweetener pump 320 may be a convention pressurized diaphragm pump and the like capable of pumping a viscous fluid. The sweetener pump 320 may be driven by a flow of carbon dioxide and the like from the carbon dioxide source 180 or elsewhere. A conventional vacuum regulator 330 also may be used.

The sweetener circuit 300 may include a controlled gear pump 340 to meter the flow of sweetener therethrough. The controlled gear pump 340 may be of conventional design. Other types of positive displacement devices also may be used that are capable of pumping a viscous fluid. The controlled gear pump 340 may be vented to remove air therein.

The sweetener circuit 300 also may include a sweetener heat exchanger 350. The sweetener heat exchanger 350 may be of conventional design. The sweetener heat exchanger 350 may be in communication with a flow of cooling water from the chiller/carbonator 160 or from other source of a cooling fluid. The sweetener may be at about 32 to about 40 degrees Fahrenheit (about 0 to about 4.4 degrees Celsius) at about 0 to about 35 psi (about 0 to about 2.4 bar).

The sweetener circuit 300 may extend to a sweetener dispensing head 360 via a shutoff valve 370. The sweetener dispensing head 360 and the shutoff valve 370 may be of conventional design and may be similar to the components described above. Other components and other configurations may be used herein.

Figure 2:
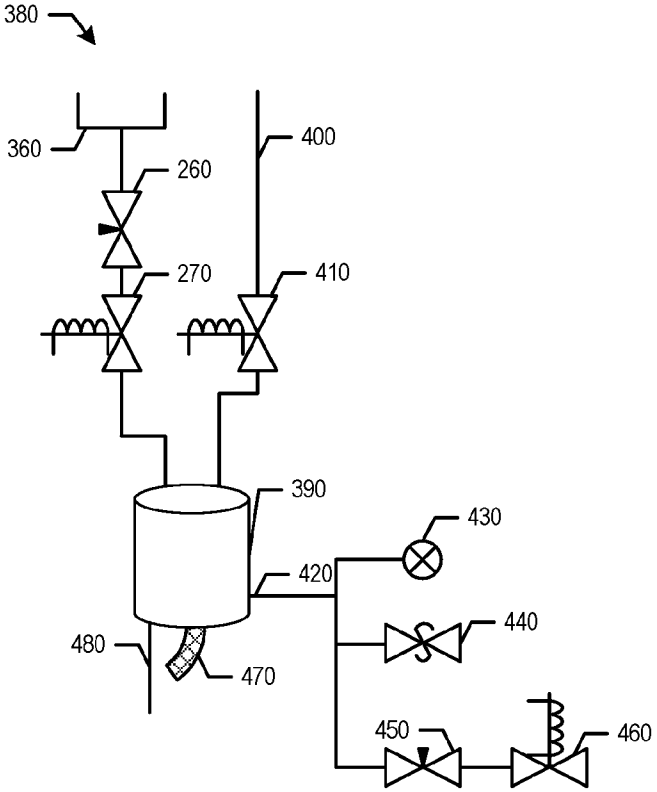
FIG. 2 is a schematic diagram of a counter pressure nozzle for use in the filling line of FIG. 1.

The still water dispensing head 240 and the carbonated water dispensing head 280 may be positioned adjacent to each other. The carbonated water dispensing head 280 may include a counter pressure nozzle 380. As is shown in FIG. 2, the counter pressure nozzle 380 may include a counter pressure filler head 390. The counter pressure filler head 390 may be in communication with the carbonated water line 210 via the flow meter 260 and the shut off valve 270. The counter pressure filler head 390 also may be in communication with the carbon dioxide source 180 via a carbon dioxide pressurization line 400 and a shut off valve 410 thereon. The counter pressure filler head 390 also may include a vent line 420. The vent line 420 may include a pressure gauge 430, a pressure relief valve 440, as well as a flow meter 450 and a shut off valve 460 and the like. A dip tube 470 may extend below the counter pressure filler head 390. The dip tube 470 may be angled in whole or in part. The counter pressure filler head 390 may be driven up and down a dispensing rail 480. Other components and other configurations may be used herein.

The filing line 100 may include a number of micro-ingredient towers 500 to dispense the micro-ingredients. Any number of the micro-ingredient towers 500 may be used herein with any number of micro-ingredient packages 510 therein. In one embodiment shown in FIG. 3, the micro-ingredient towers 500 may include an upper loading section 520 and a lower dispensing section 530. Some or all of the loading sections 520 and the dispensing sections 530 may be agitated depending up the nature of the micro-ingredients intended to be used therein. In this example, six micro-ingredient towers 500 with each loading section 520 having eight loading trays 540 are shown although any number may be used herein. Each loading tray 540 may contain a micro-ingredient package 510 therein. Each micro-ingredient package 510 may be attached to the loading tray 540 via a loading fitting 550 and the like. Given the use of eight loading trays 540 in each of the six micro-ingredient towers 500, a total of 48 different micro-ingredients may be used herein. Any number of ingredient towers 500 with any number of loading trays 540 may be used herein to provide any number of micro-ingredients. Alternatively, multiple hoppers of any size may be used with the micro-ingredients.

The dispensing section 530 may have the same number of dispensing trays 560 as the loading section 520 has loading trays 540. Each dispensing tray 560 may have a dispensing pouch 570 therein. Each dispensing pouch 570 may have a pouch inlet 580 and a pouch outlet 590. Each dispensing pouch 570 may be in communication with a related micro-ingredient package 510 via an ingredient line 600 and the pouch inlet 580. The ingredient line 600 may include a three way valve thereon to allow the micro-ingredient package 510 to be replaced without introducing air into the system. The micro-ingredients in the micro-ingredient packages 510 thus flow to the related dispensing pouch 570 so as to maintain a fill level therein. The micro-ingredient pouches 570 may be positioned on a pressure pad 605. The pressure pad 605 may be a Polymer Thick Film (PTF) sensor and the like that exhibits a change in resistance with a change in applied force. Each dispensing pouch 570 also may be in communication with a dispensing pump 610 via the pouch outlet 590. The dispensing pump 610 may be a vibratory pump and the like. Other types of positive displacement pumps may be used. A backflow preventer valve also may be used. Other components and other configurations may be used herein.

Each micro-ingredient tower 500 may include a micro-nozzle head 620. The micro-nozzle head 620 may be 3D printed from a conventional thermoplastic or formed from a conventional metal and the like. Any assortment of materials may be used herein. Each dispensing pouch 570 may be in communication with the micro-nozzle head 620 via a dispensing line 630 and the dispensing pump 610. Each micro-nozzle head 620 in turn may have a number of micro-ingredient tubes 640 attached to a number of dispensing needles 650. Each dispensing needle 650 may be attached to the micro-nozzle head 620 and the dispensing line 630 via Luer lock fitting and the like for easy replacement. The dispensing needles 650 may be angled to dispense towards the center of the mouth of the container 110. Although a circular configuration is shown, any configuration may be used herein. The dispensing needles 650 may be made out of stainless steel or similar types of materials. A small air gap may be used between the dispensing needles 650 and the container 110 and/or the micro-nozzle head 620 may form a seal about the container 110. An air blast may be used between dispenses to blow off droplets of micro-ingredients. Other components and other configurations may be used herein.

Figure 4:
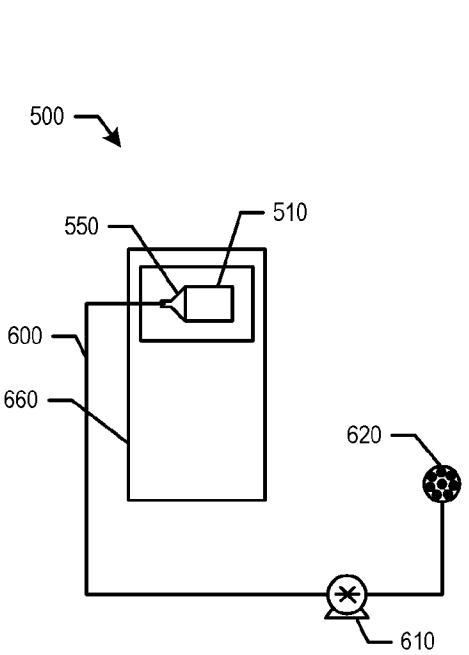
FIG. 4 is a schematic diagram of an alternative embodiment of a micro-ingredient tower for use with the filling line of FIG. 1.

FIGS. 1 and 4 show a simplified version of the micro-ingredient towers 500. In this example, a single section 660 may be used with the micro-ingredient package 510 and the fitting 550 in direct contact with the dispensing pump 610 and the micro-ingredient nozzle head 620 via the micro-ingredient line 600. Other components and other configurations may be used herein.

Figure 6:
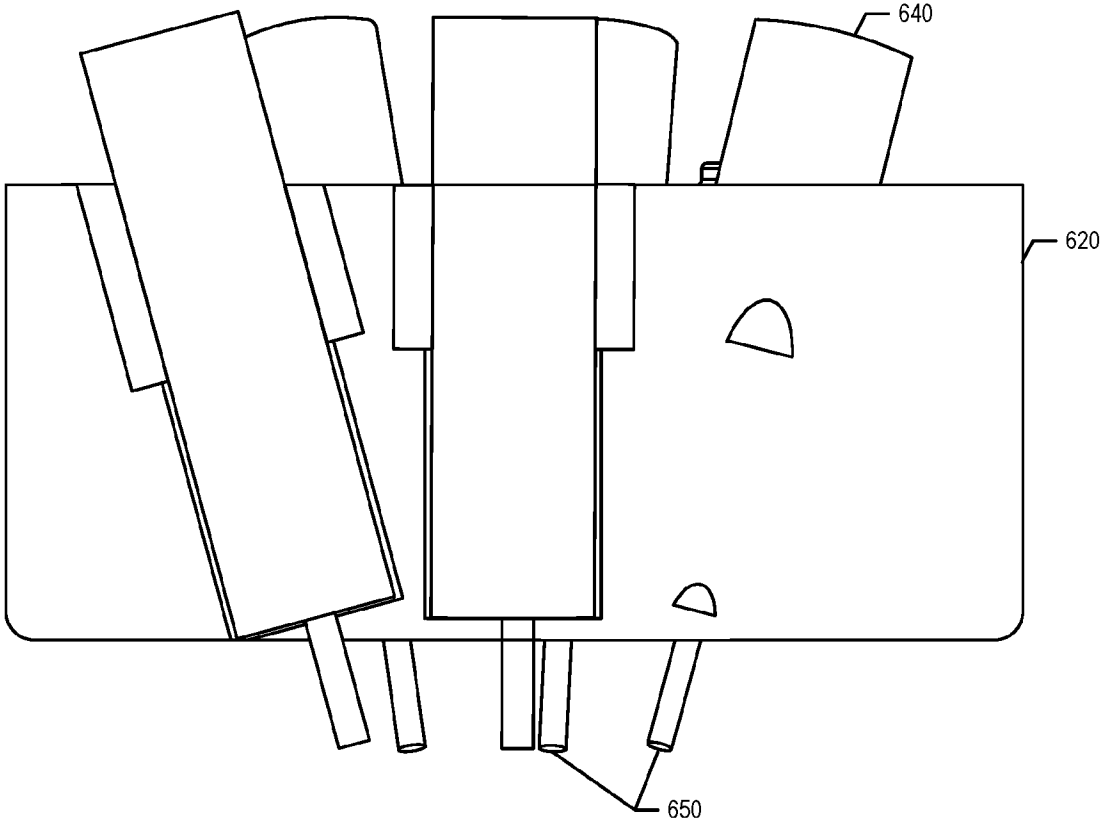
FIG. 6 is a section view of a micro-dosing head for use with the micro-ingredient towers of FIGS. 3 and 4.
Figure 5:
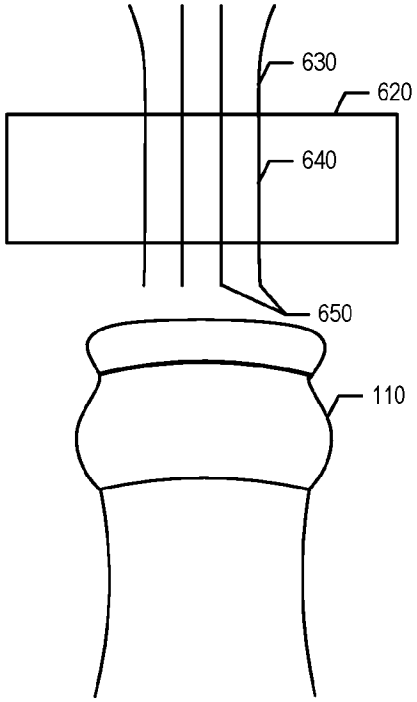
FIG. 5 is a schematic diagram of a micro-dosing head for use with the micro-ingredient towers of FIGS. 3 and 4.
Figure 8:
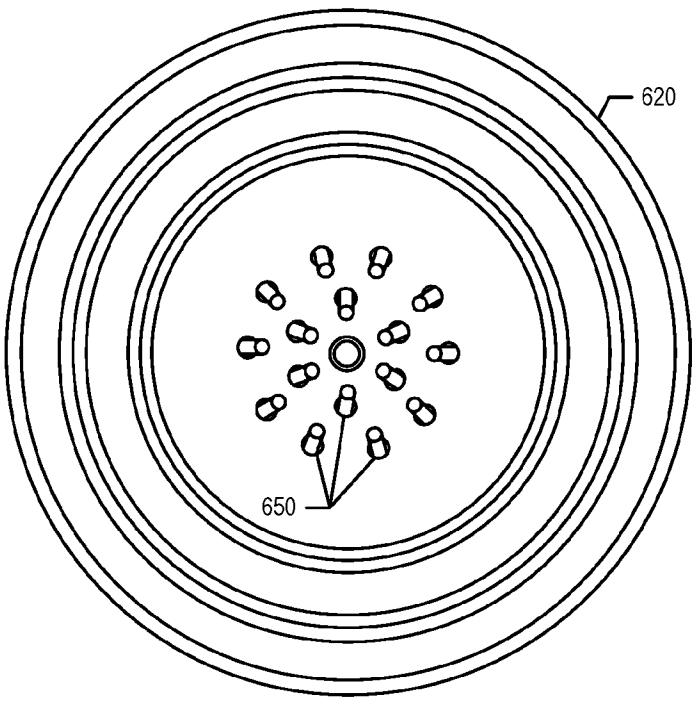
FIG. 8 is a bottom plan view of the dosing needles of an alternative embodiment of a micro-dosing head.
Figure 7:
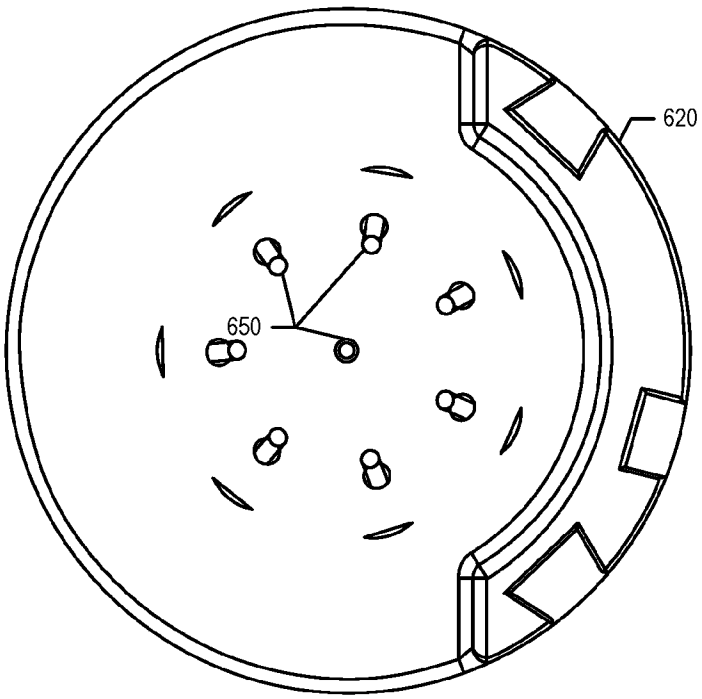
FIG. 7 is a bottom plan view of the dosing needles of the micro-dosing head of FIG. 6.

The size and number of the dispensing lines 630, the dispensing tubes 640, and the dispensing needles 650 may vary. As shown in FIGS. 5-7, for example, eight dispensing lines 630 may be attached to each micro-nozzle head 620 given the use of eight dispensing trays 560. Eight dispensing needles 650 with an inner diameter of about 0.03 inches and an outer diameter of about 0.05 inches may be evenly spaced within a 0.5 inch outer diameter for use with filling a container 110 having a mouth with an inner diameter of about 0.65 inches. The size and number of the dispensing needles 650 may vary. FIG. 8 shows a micro-nozzle head 620 with sixteen dispensing needles 650.

Figure 10:
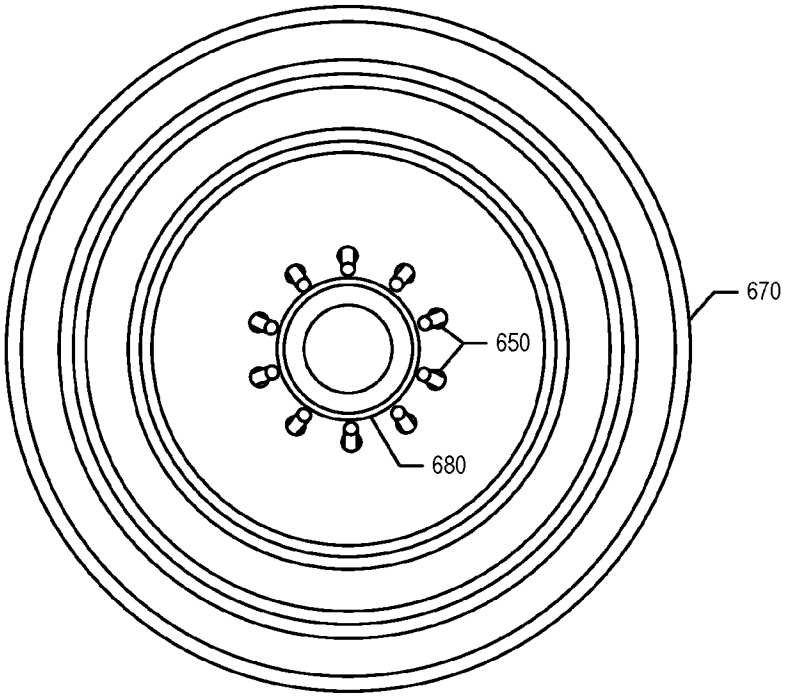
FIG. 10 is a bottom plan view of the combination micro/macro dosing head of FIG. 9.
Figure 9:
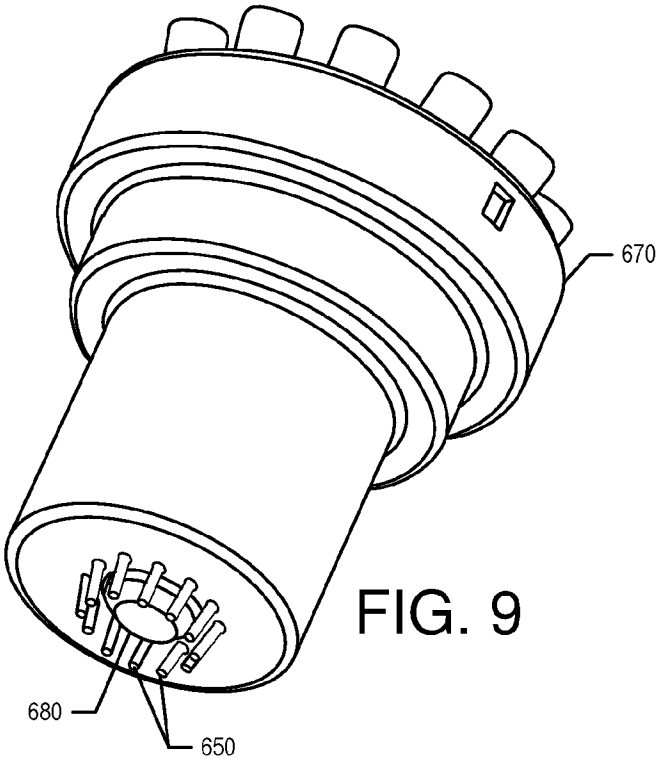
FIG. 9 is a perspective view of an alternative embodiment of a combination micro/macro dosing head.

FIGS. 9 and 10 show a further embodiments with a combination micro/macro nozzle head 670. In this example, the combination micro/macro nozzle head 670 may include twelve dispensing needles 650 positioned about a central macro-ingredient nozzle 680. Any number of dispensing needles 650 and macro-ingredient nozzles 680 may be used herein in any configuration.

Referring again to FIG. 1, the still water dispensing head 240, the carbonated water dispensing head 280, the sweetener nozzle 360, and the micro-ingredient towers 500 may be positioned about a filling transfer line 690. The filling transfer line 690 may be a conventional continuous or intermittent conveyor. Rotary fillers, star wheel lines, and the like also may be used. The speed of the filling transfer line 690 may vary. Multiple lanes may be used. The specific positioning of the water heads 240, 280, the sweetener nozzle 360, and the micro-ingredient towers 500 provides for a well-mixed finished beverage. If the micro-ingredients or the macro-ingredients were added before the water, the beverage may have excessive foam. If the macro-ingredients were added before the micro-ingredients, the micro-ingredients may not fully mix. The order of water, macro-ingredients, and micro-ingredients thus has been found to promote reduced foaming. If the macro-ingredients are added after the micro-ingredients, then a container inversion arrangement may be used to facilitate good mixing. Other types of agitation may be used herein.

In use, the container 110 may be marked with the identifier 120. The identifier 120 may indicate to the filling line 100 the nature of the beverage to be filled within the container 110 along the filling transfer line 690. Other types of information also may be communicated. As the container 110 advances along the filling transfer line 690, the sensors 125 may read the identifier 120 and the filling line 100 may determine the correct recipe.

At the still water dispensing head 240 and/or the carbonated water dispensing head 280, still and/or carbonated water may be added to the container 110. When the container 110 is positioned about the counter pressure nozzle 380, the counter pressure filler head 390 may be lowered along the dispensing rail 480 such that the dip tube 470 is within the container 110 and the counter pressure filler head 390 creates a seal thereon. The shut off valve 410 may be opened to pressurize the container 110 with carbon dioxide. The shut off valve 410 may be opened for a fixed amount of time to sufficiently pressurize the container 110. The pressure relief valve 440 may vent the container 110 when the pressure exceeds a predetermined limit, in this case about 20 psi (about 1.4 bar). Other pressures may be used herein.

The carbonated water line 210 then may be opened to fill the container 110. The flow of carbonated water may be regulated by the flow meter 260 and the shut off valve 270 for a predetermined amount of time to dispense a predetermined volume. The back pressure may be maintained by the pressure relief valve 440 so as to maintain a constant flow rate. The angled dip tube 470 directs the water stream to the top section of the container 110 for a smooth transition of water along the side walls to prevent excess foaming/breakout and maintain soda water carbonation. The flow meter 450 and shut off valve 460 may be used to vent the container 110. The flow meter 450 may be a needle valve that is adjusted to control the rate at which the container 110 is depressurized. If the container 110 vents too quickly the soda water may have breakout and foam. If the container 110 vents too slowly the soda water may not foam but the cycle time may increase and overall production rate/efficiency may decrease. The counter pressure filler head 390 then may be raised.

The counter pressure nozzle 380 thus supplies carbonated water at higher carbonation levels than the finished product in order to compensate for the expected loss of carbon dioxide while filling until the container is capped or otherwise enclosed. The container 110 may have a predetermined limit on the amount of time elapsed between the counter pressure nozzle 380 and capping. The predetermined amount of time may be about 90 seconds or so.

The filling transfer line 690 then may advance the container 110 to the macro-ingredient nozzle 360. The amount of the macro-ingredient to be added may be metered by the controlled gear pump 340 according to the specific recipe. The filling transfer line 690 then may advance the container 110 to some or all of the micro-ingredient towers 500. Micro-ingredients may be added from any of the dispensing needles 650 of the nozzle heads 620 from any of the micro-ingredient towers 500 according to the specific recipe of the beverage to be added. Any number of the micro-ingredients may be added in any order. The filling transfer line 690 then may advance the container 110 to a capper or to another station for further processing.

Figure 3:
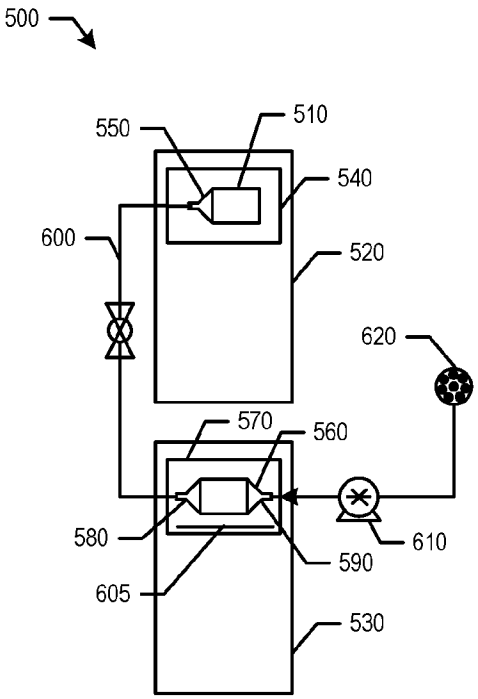
FIG. 3 is a schematic diagram of a micro-ingredient tower for use with the filling line of FIG. 1.
Figure 11:
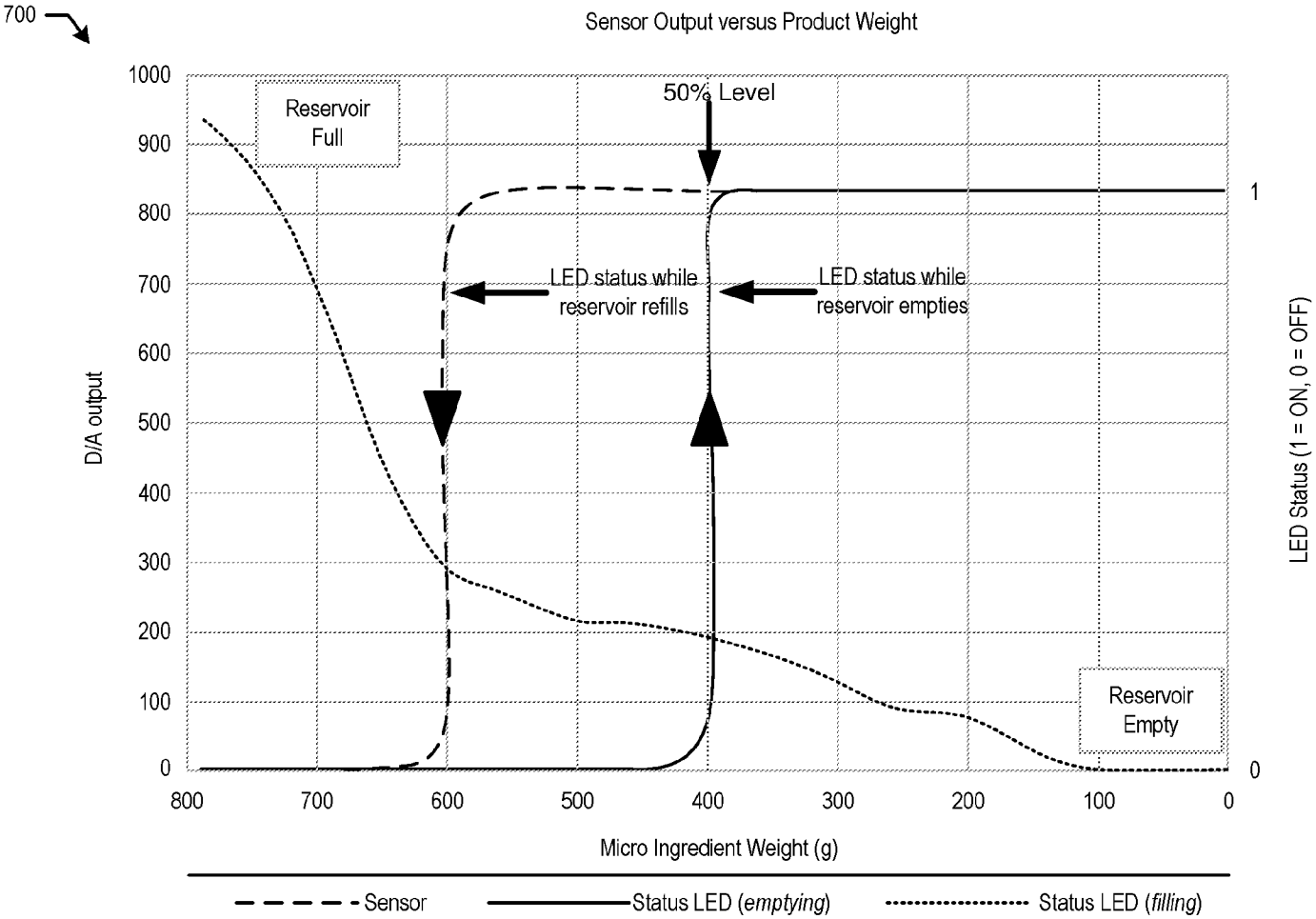
FIG. 11 is a graph showing D/A Output verses Micro-ingredient Weight in a sold out system for use with the filling line of FIG. 1.

In order to keep the filling line 100 operational without downtime to replace spent micro-ingredients, a sold out system 700 may be used. As is shown in FIG. 3, the sold out system 700 may use the pressure pad 605 positioned under each dispensing pouch 570 in each dispensing tray 560 in the dispensing section 530 of the micro-ingredient towers 500. As is described above, the pressure pad 605 may be a Polymer Thick Film (PTF) sensor and the like that exhibits a change in resistance with a change in applied force. As is shown in FIG. 11, the sold out system 700 may use an LED indication or other type of indication when a particular dispensing pouch 570 is less than about 50% full or so. The sold out system 700 may send a shutdown signal to the filling line 100 when the dispensing pouch 570 is less than about 20% full or so to prevent a no product condition. An operator then may add a new micro-ingredient package 510 in the appropriate loading tray 540 in the loading section 520.

The sold out system 700 also may use a "fuel gauge" to keep track of the micro-ingredients used and remaining in the micro-ingredient packages 510 in the loading section 520. The fuel gauge may be software that tracks the operation of the dispensing pump 610 or other parameter to estimate the use of the micro-ingredients. The fuel gauge ensures that the micro-ingredient packages 510 are replaced in time so as to prevent air entrapment or pulling a vacuum. The sweetener source 310 in the sweetener circuit 300 may have a switch over valve and the like that allows the connection to a new bag-in-box or other container as needed. Other components and other configurations may be used herein.

Figure 12:
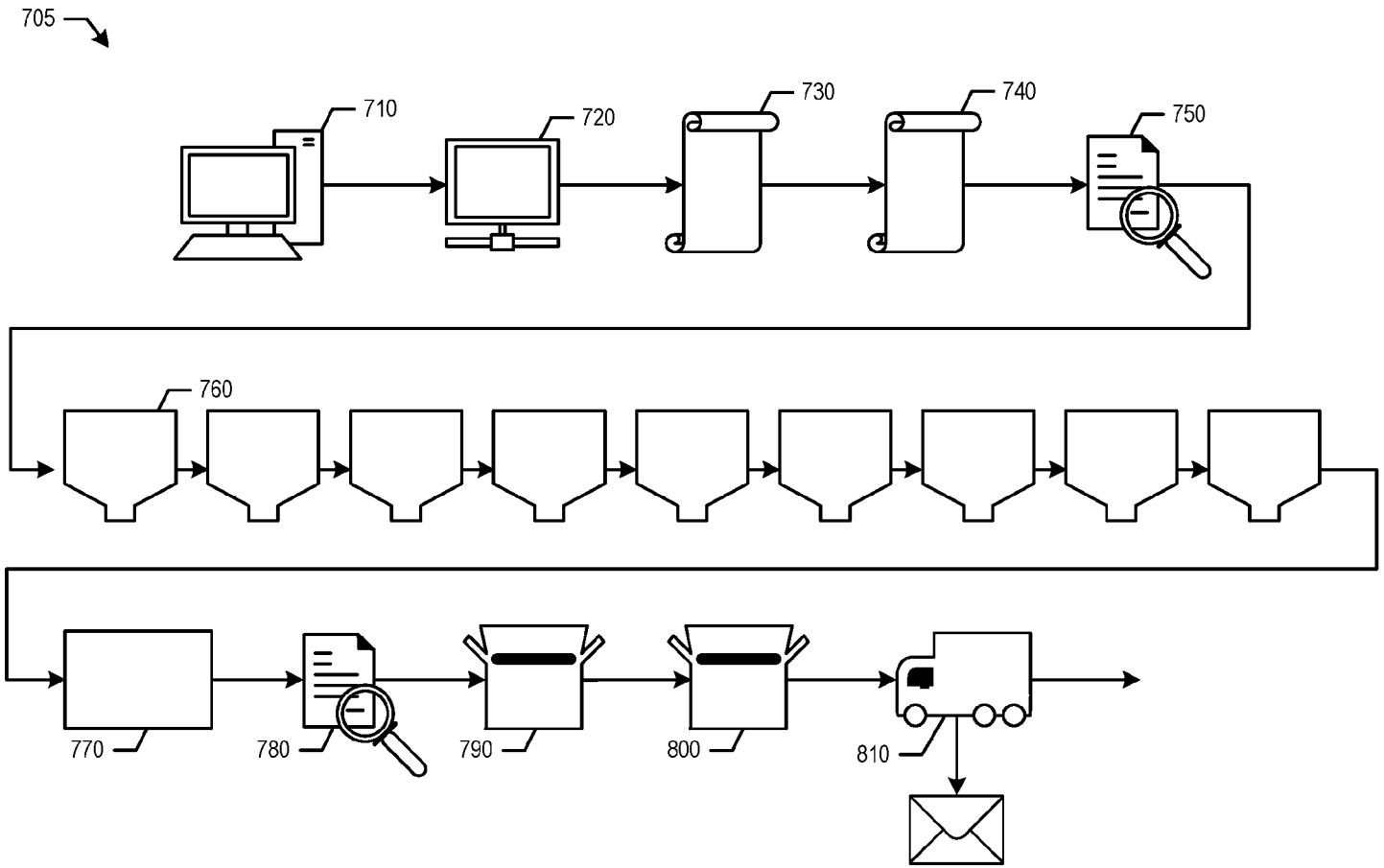
FIG. 12 is a schematic diagram showing an e-commerce system for use with the filling line of FIG. 1.

The flexibility in producing any number of different beverages on the fly thus creates the ability to produce personalized beverage mixes by using the filling line 100. For example, a consumer may order a personalized six pack of beverages with six different beverages or flavors and have that six pack delivered to home or elsewhere. FIG. 12 is a schematic diagram of an example of an e-commerce beverage system 705 as may be described herein. At station 710, the consumer may visit a webpage or a smartphone app and select and purchase the desired beverage package mix. The consumer may supply sample information such as payment, shipping, and order quantities. At station 720, the user may determine the appropriate recipes, quantity, address, graphics, and other types of information. At station 730, the user may print that information on to a label. In other words, the identifier 110 may be printed onto a container label. At station 740, the label may be applied to the container 110. At station 750, the sensor 125 may read the identifier and the filling line 110 may determine the appropriate recipe. At stations 760, the filling line 100 may fill the container 110 with the desired beverage. At station 770, the container 110 may be capped or otherwise enclosed. At station 780, the order may be validated in an appropriate manner. A station 790, the containers 110 in a given order may be consolidated and packaged. At station 800, further packaging and a shipping label may be prepared. At station 810, the order may be shipped to the consumer. Other and different method steps may be used herein in any order. For example, the container 110 may be label before or after filling. A rinsing step and the like also may be used.

The various circuits and nozzles also may be calibrated periodically to ensure correct pour volumes according to recipe requirements. For example, a first three dispensing needles 650 may be removed from the nozzle head 620 and attached into a designated location on a first micro-ingredient measurement scale and a second three dispensing needles 650 may be removed from the nozzle head 620 and attached into a designated location on a second micro-ingredient measurement scale. The dispensing pumps 610 may be triggered one at a time to dispense a known amount about three to five times with the amount measured each time. The scales may be tared between each reading. An average may be calculated and a correlation factor may be calculated such that the pump curves may be adjusted accordingly to reflect the updated performance of each pump. Similar calibration methods also may be used for the water and the sweetener pumps.

The use of the filling line 100 in the e-commerce beverage system 705 thus brings the flexibility of, for example, the "COCA-COLA FREESTYLE®" refrigerated beverage dispensing unit to the filling line 100 so as to create personalized beverage package mixes. The personalized products then may be delivered directly to the consumer in a fast and efficient manner. The filling line 100 thus may produce any number of different products without the downtime usually associated with known filling systems. As a result, multi-beverage package mixes may be created as desired with differing products therein.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof

We claim:

1. A filling line for filling a container with one of a number of different beverages, comprising:

a water circuit;

the water circuit comprising a counter-pressure nozzle to fill the container with carbonated water at a higher carbonation level than a capped beverage;

a sweetener circuit with a sweetener nozzle positioned downstream of the counter-pressure nozzle; and one or more micro-ingredient towers with a plurality of micro-ingredients therein positioned downstream of the counter-pressure nozzle and the sweetener nozzle to fill the container with a plurality of micro-ingredients.

2. The filling line of claim 1, further comprising a transfer line with the counter pressure nozzle and the one or more micro-ingredient towers positioned thereabout.

3. The filling line of claim 1, wherein the water circuit comprises a still water line and a carbonated water line.

4. The filling line of claim 3, wherein the carbonated water line comprises a recirculation line.

5. The filling line of claim 1, wherein the counter-pressure nozzle comprises a dip tube extending into the container.

6. The filling line of claim 1, wherein the counter-pressure nozzle comprises a rail for vertical movement above the container.

7. The filling line of claim 1, wherein the one or more micro-ingredient towers comprise a loading section, a dispensing section, and a nozzle head.

8. The filling line of claim 7, wherein the loading section comprises a plurality of loading trays with a plurality of micro-ingredient packages.

9. The filling line of claim 8, wherein the dispensing section comprises a plurality of dispensing trays with a plurality of dispensing pouches.

10. The filling line of claim 9, wherein the plurality of micro-ingredient packages is in fluid communication with the plurality of dispensing pouches.

11. The filling line of claim 9, wherein the plurality of dispensing pouches is in fluid communication with the nozzle head.

12. The filling line of claim 7, wherein the nozzle head comprises a plurality of dispensing needles.

13. The filling line of claim 1, wherein the dispensing section comprises a sold out system.

* * * * *